US007677306B2

(12) United States Patent
Lecampion et al.

(10) Patent No.: US 7,677,306 B2
(45) Date of Patent: Mar. 16, 2010

(54) HYDRAULIC FRACTURING

(75) Inventors: Brice Tanguy Alphonse Lecampion, Menilles (FR); Emmanuel Michel Marcel Detournay, Roseville, MN (US)

(73) Assignee: Commonwealth Scientific & Industrial Research Organisation, Campbell (AU)

( * ) Notice: Subject to any disclaimer, the term of this patent is extended or adjusted under 35 U.S.C. 154(b) by 242 days.

(21) Appl. No.: 10/572,275

(22) PCT Filed: Sep. 16, 2004

(86) PCT No.: PCT/AU2004/001263

§ 371 (c)(1),
(2), (4) Date: Feb. 14, 2007

(87) PCT Pub. No.: WO2005/026496

PCT Pub. Date: Mar. 24, 2005

(65) Prior Publication Data

US 2007/0235181 A1 Oct. 11, 2007

(30) Foreign Application Priority Data

Sep. 16, 2003 (AU) ..... 2003905047

(51) Int. Cl.
*E21B 49/00* (2006.01)
*E21B 43/26* (2006.01)

(52) U.S. Cl. ..... 166/250.1; 166/250.01; 166/308.1; 166/305.1; 166/177.5

(58) Field of Classification Search ..... 166/205.01, 166/250.1, 305.1, 307, 308.1, 177.5
See application file for complete search history.

(56) References Cited

U.S. PATENT DOCUMENTS

| | | | | |
|---|---|---|---|---|
| 7,128,153 | B2 * | 10/2006 | Vinegar et al. | 166/285 |
| 2004/0016541 | A1 * | 1/2004 | Detournay et al. | 166/250.1 |
| 2004/0206495 | A1 * | 10/2004 | Lehman et al. | 166/250.1 |

* cited by examiner

*Primary Examiner*—Jennifer H Gay
*Assistant Examiner*—Brad Harcourt
(74) *Attorney, Agent, or Firm*—Merchant & Gould P.C.

(57) ABSTRACT

Method and apparatus for estimating a fluid driven fracture volume during hydraulic fracturing treatment of a ground formation. A series of tiltmeters are positioned at spaced apart tiltmeter stations at which tilt changes due to the hydraulic fracturing treatment are measurable by those tiltmeters. Tilt measurements obtained from the tiltmeters at progressive times during the fracture treatment are analysed to produce estimates of the fluid driven fracture volume at each of those times as the treatment is in progress. The analysis may be performed sufficiently rapidly to provide real time estimates of the fluid driven fracture volume and may also produce estimates of fracture orientation. The estimates of fracture volume may be compared with the volume of fluid injected to derive an indication of treatment efficiency.

4 Claims, 7 Drawing Sheets

HYDRAULIC FRACTURING

TECHNICAL FIELD

This invention relates to hydraulic fracturing of natural ground formations which may be on land or under a sea bed.

Hydraulic fracturing is a technique widely used in the oil and gas industry in order to enhance the recovery of hydrocarbons. A fracturing treatment consists of injecting a viscous fluid at sufficient rate and pressure into a bore hole drilled in a rock formation such that the propagation of a fracture results. In later stages of the fracturing treatment, the fracturing fluid contains a proppant, typically sand, so that when the injecting stops, the fracture closes on the proppant which then forms a highly permeable channel (compared to the permeability of the surrounding rock) which may thus enhance the production from the bore hole or well.

In recent years, hydraulic fracturing has been applied for inducing caving and for preconditioning caving in the mining industry. In this application, the fractures are typically not propped but are formed to modify the rock mass strength to weaken the ore or country rock.

One of the most important issues in the practice of the hydraulic fracturing technique is knowledge of the geometry (orientation, extent, volume) of the created fracture. This is of particular importance in order to estimate the quality of the treatment performed. However, operators presently have no direct measurement capability allowing them to verify the quality and effectiveness of their operations. It is only afterwards when production has restarted that the performance of the created fracture can be assessed.

In order to map hydraulic fractures, several types of indirect measurements can be carried out such as microseismic acoustic monitoring and tiltmeter mapping, but such surface tiltmeter techniques have not so far been capable of producing accurate information which can be used during the course of a hydraulic fracturing treatment and generally only provide data for later analysis. By the present invention, it is possible to obtain useful data on the effectiveness of a hydraulic treatment as the treatment progresses.

DISCLOSURE OF THE INVENTION

The invention broadly provides a method for estimating a fluid driven fracture volume during hydraulic fracturing treatment of a ground formation, comprising:

positioning a series of tiltmeters at spaced apart tiltmeter stations at which tilt changes due the hydraulic fracturing treatment are measurable by those tiltmeters;

obtaining from the tiltmeters tilt measurements at progressive times during the fracturing treatment; and deriving from the tilt measurements at each of said times an estimate of the fluid driven fracture volume at that time by performing an analysis to produce estimates of the fluid driven fracture volume at each of said times as the treatment is in progress.

The method may further comprise the steps monitoring the volume of fluid injected during the treatment and comparing the estimate of the fracture volume at each of said times with the volume of injected fluid at that time to derive an indication of treatment efficiency.

The analysis may be performed sufficiently rapidly to provide real-time estimation of the fluid driven fracture volume.

The analysis may further produce estimates of fracture orientation as the treatment is in progress. The method may thus provide real-time estimates of fluid driven fracture volume, and, by making use of the measured injected volume, the treatment efficiency, and the detection in real-time of fracture orientation or changes in fracture orientation (both strike and dip).

The analysis at a given time may be based on minimisation of misfit between the tilt measurements at this given time and tilts predicted by a fracture model.

The fracture model may predict tilts by simulating a finite hydraulic fracture using, for example, a displacement discontinuity model. The computational cost of such model should be low, typically of the order of 1/10 second per prediction calculation. This can be achieved, for example, by using a fracture model consisting of a displacement discontinuity singularity with an intensity equal to the volume of the simulated fracture. Each tilt prediction computation may take of the order of 1/10 seconds. There may be of the order of 100 to 300 evaluations performed to complete the minimization analysis for deriving the fracture volume and fracture orientation at a given time. Therefore, typically, the analysis may be carried out at regular intervals of about every 10 seconds to 5 minutes, and typically of the order of 1 minute, throughout the fracturing treatment.

The tiltmeter stations may be located at the surface of the ground formation and/or within one or more bore holes within the ground formation or within tunnels in the case of a mine.

In order to ensure best accuracy of the analysis, the tiltmeter stations should be located sufficiently far from the fracture that only the orientation and volume of the fracture has an effect on the tilt fields. In that case, it is recognised that it is impossible to separate the effect of both the length and opening of the fracture so that only the volume of the fracture and it's orientation can be obtained by inversion of the tilt data.

The invention further provides apparatus for estimating a fluid driven fracture volume during hydraulic fracturing treatment of a ground formation, comprising:

a series of tiltmeters positionable at spaced apart tiltmeter stations to measure tilt changes due to the hydraulic fracturing treatment; and a signal processing unit to receive tilt measurement signals from the tiltmeters at progressive times during the fracturing treatment and operable to derive at each of said times an estimate of the fluid driven fracture volume at that time by performing an analysis sufficiently rapid to produce estimates of the fluid driven fracture volume as the treatment is in progress.

The apparatus may further include a flow meter for measuring the flow of hydraulic fracturing fluid injected during a fracturing treatment and the signal processing unit may be operable to receive signals from the flow meter and to compare the estimate of fracture volume at each of said times with the volume of injected fluid as measured by the flow meter so as to derive an indication of treatment efficiency.

The signal processing unit may also be operable to derive from the tilt measurements estimates of fracture orientation at each of said times.

BRIEF DESCRIPTION OF THE DRAWINGS

The invention and the manner in which it may be put into effect will now be described in more detail with the aid of the twenty two references listed at the end of this specification and the accompanying drawings, in which.

DETAILED DESCRIPTION OF THE PREFERRED EMBODIMENT

In order to explain the operation of the preferred method and apparatus and according to the invention, it will be necessary to analyse in some detail the current state of the art in the operation of tiltmeters and the modelling and resolution techniques required to derive meaningful data from tiltmeter measurements.

Tiltmeter State of the Art

Figure 1:
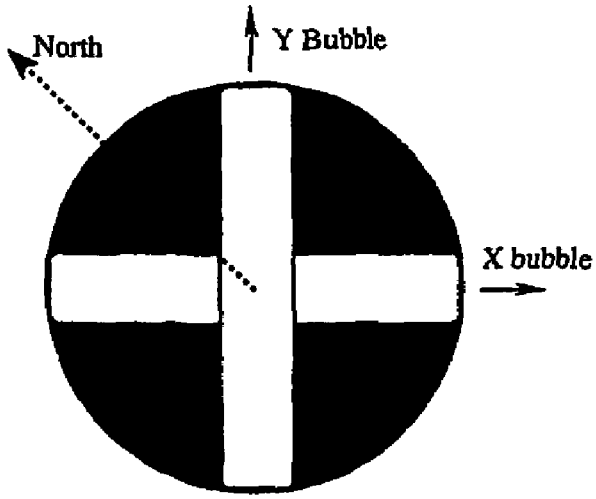
FIG. 1 illustrates the principle of tiltmeter measurement.
Figure 2:
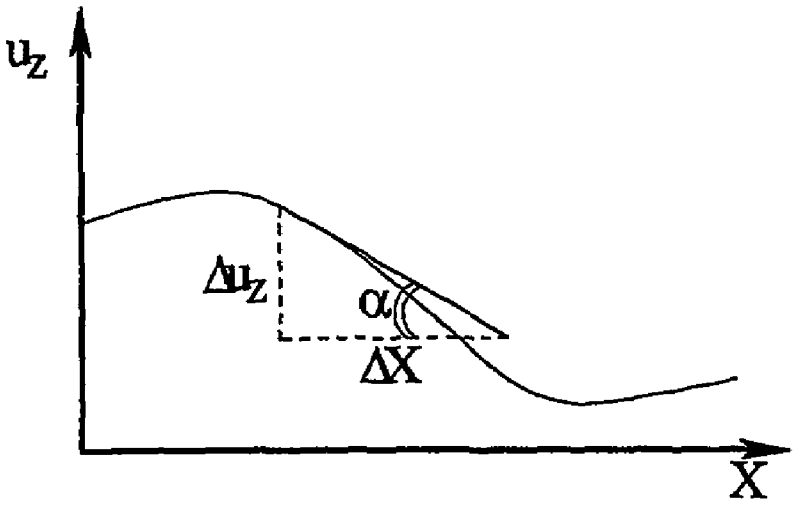
FIG. 2 shows the relation between inclinations (tilts) and uplift gradient.

A tiltmeter (which is installed tightly in the rock) measures, at it's location, changes in the surface tilt in two orthogonal directions (see FIGS. 1 and 2). The tilts are a direct measure of the horizontal gradient of the vertical displacement. High precision apparatus developed in the last 20 years can measure changes in tilt down to one nanoradian.

Figure 3:
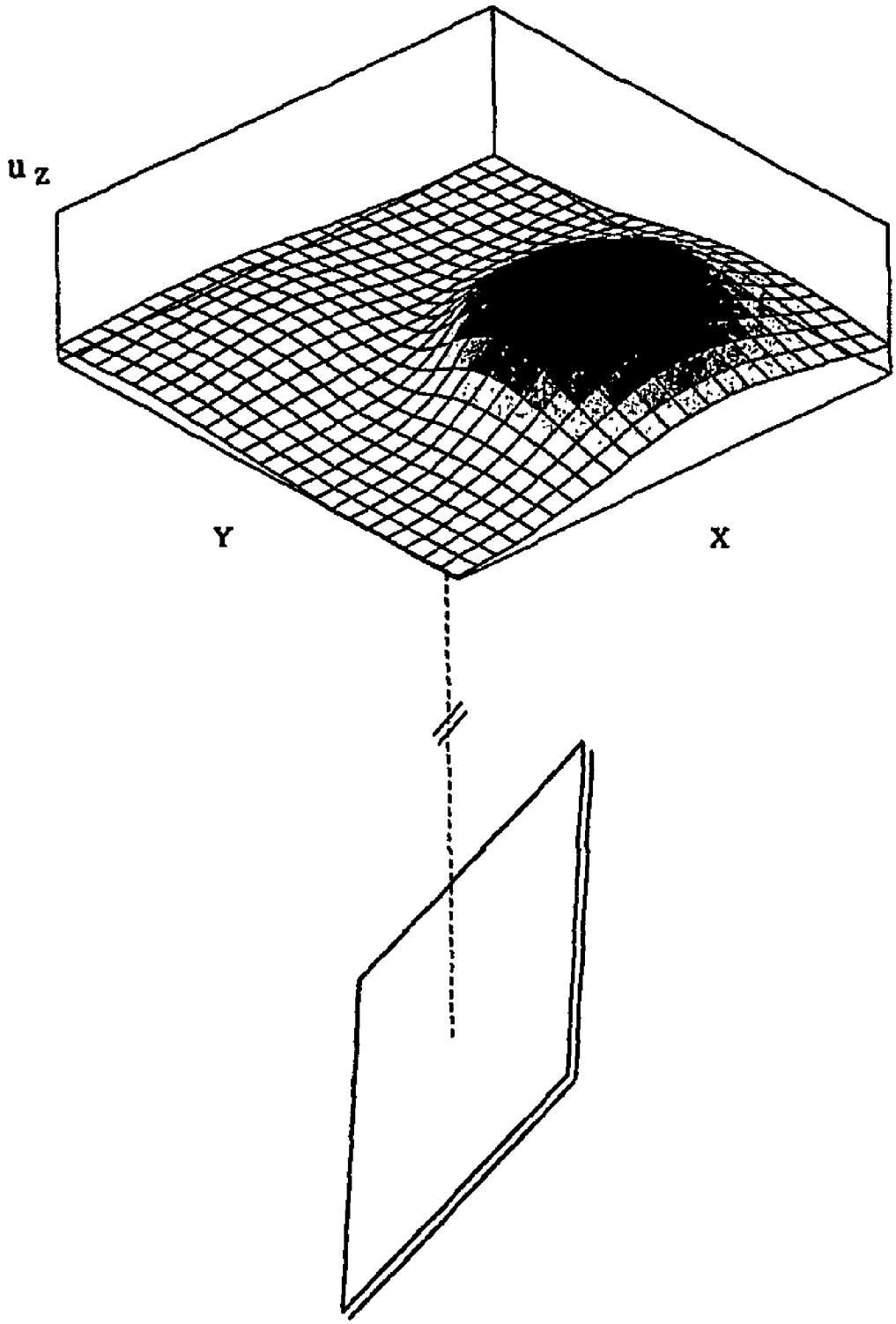
FIG. 3 illustrates diagrammatically an inclined fracture and corresponding uplift at the ground surface.

The propagation of a pressurized fracture of length L(t) and opening w(t) produces elastic deformation in the rock mass which, in turn result in a corresponding uplift and therefore a change of inclination at the location of the tiltmeter (see FIG. 3 for example). This inclination change is sampled sequentially in time at each tiltmeter and an array of tiltmeters is used to obtain tilts at several different locations remote from the hydraulic fracture. The tiltmeters can be located on the surface (surface tiltmeter array) or in a vertical borehole (borehole tiltmeter array) or in an underground tunnel.

Figure 4:
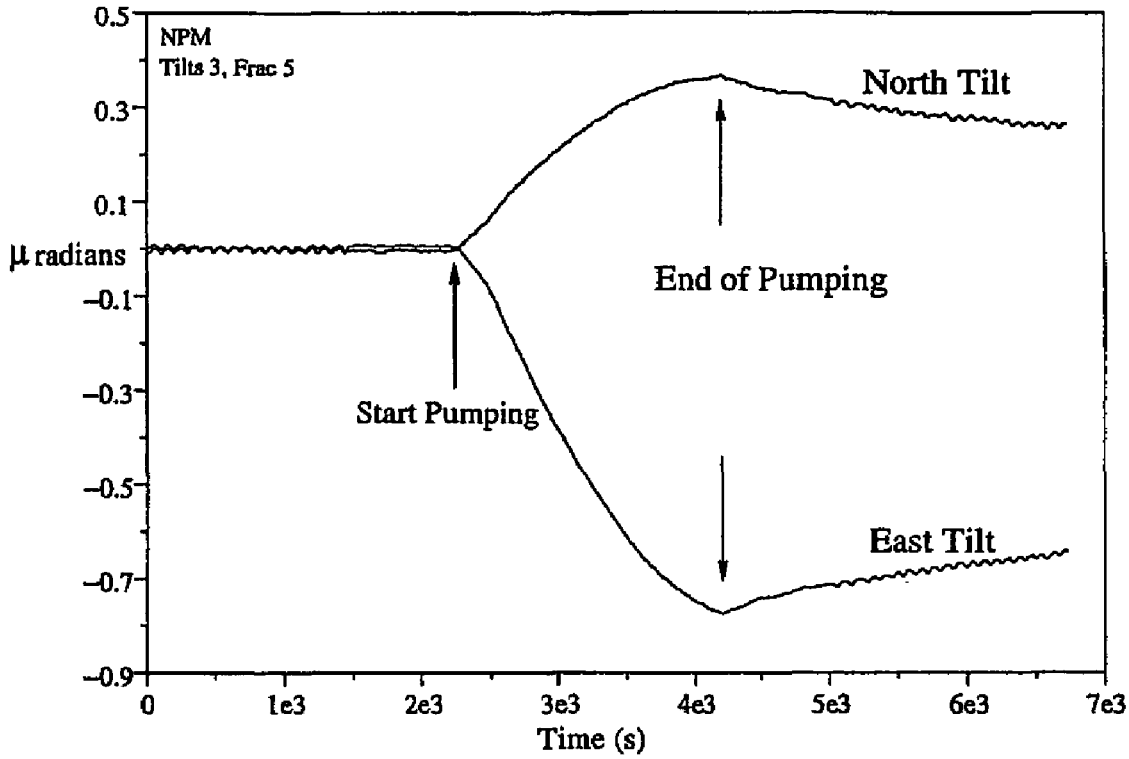
FIG. 4 illustrates the evolution in time of the inclination recorded at a tiltmeter station during a fracturing treatment.

FIG. 4 displays, for a given tiltmeter station, the two inclinations (north-south and east-west) recorded during a fracturing job. We clearly see the evolution of the inclination during injection as well as the slow return toward their initial values after the end of the injection. This return is associated with the hydraulic fracture closing back on itself after injection stops.

Figure 5:
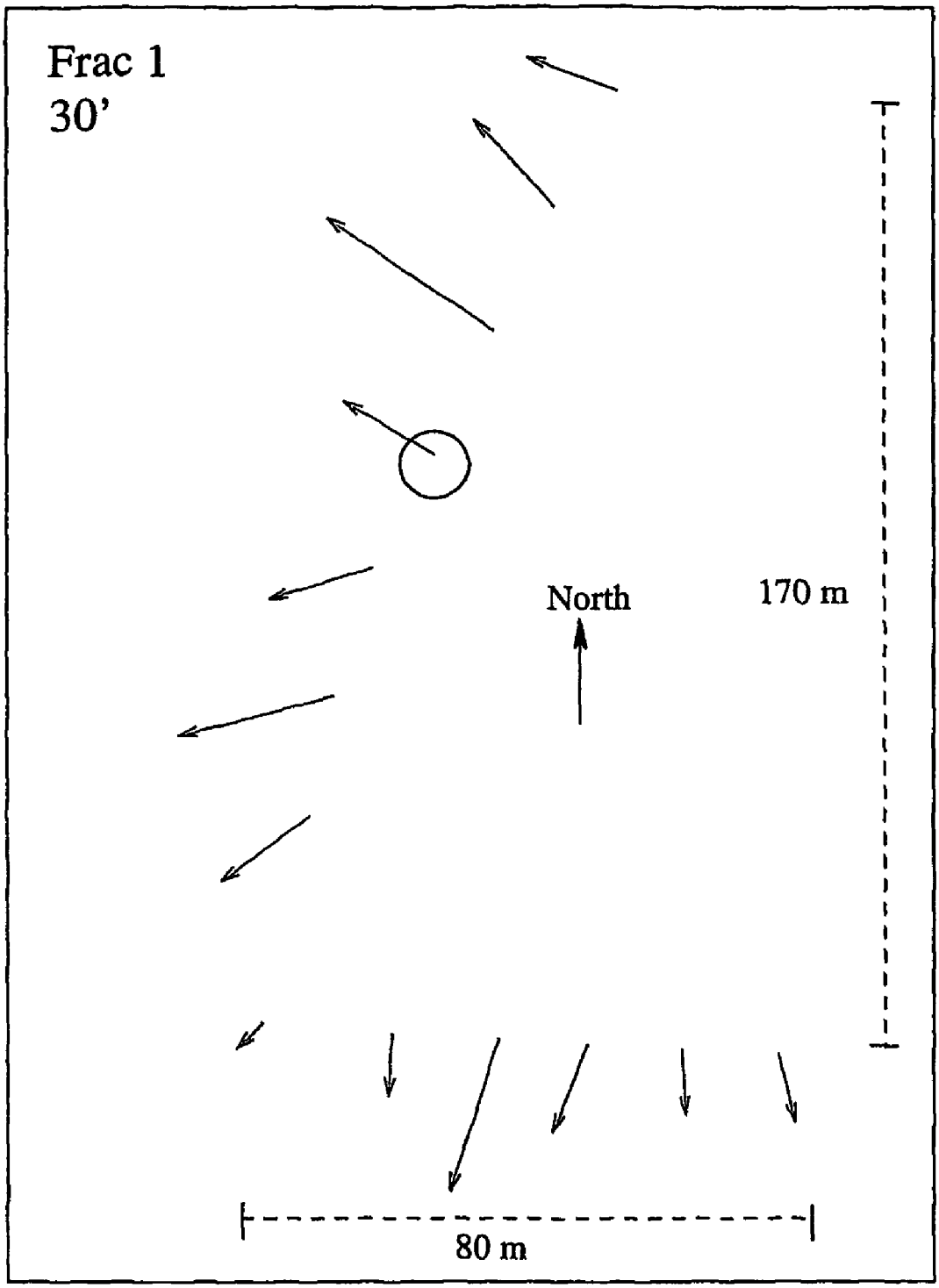
FIG. 5 illustrates tilt vectors at an array of tiltmeter stations at a particular instant of time during a fracturing treatment.

Another representation of tiltmeter measurements is given in FIG. 5. The so-called tilt vectors are shown in this figure for a particular time during the injection. This plan-view representation contains all the tiltmeter stations. The tilt vector v is determined from a vector addition of the two orthogonal components of the horizontal gradient of the vertical displacement measured by the two bubbles in the tiltmeter:

$$v = \left(\frac{\partial u_z}{\partial x}, \frac{\partial u_z}{\partial y}\right).$$

Modelling and Resolution

In contrast to the relative simplicity of the measurement, the modelling necessary to solve the related inverse problem which is required to analyse the tiltmeter data, pose difficult problems. Despite the now common use of tiltmeters to map hydraulic fractures in the petroleum industry, there is general misunderstanding of what information about the fracture can and cannot be obtained from such measurements. Based on practical experience Cipolla C. L and Wright C. A list in reference [3] some of the fracture quantities better resolved by surface or borehole tiltmeters. In addition, Larson et al in reference [20], Warpinski in reference [17] and Evans in reference [7] also list several difficulties in obtaining certain fracture parameters depending on the configuration. However, no clear statement and formal results concerning the resolution of geometrical characteristics of the fracture have been established by these papers.

The hydraulic fracture that produces the recorded tilts is most of the time modelled by using finite Displacement Discontinuities, also called dislocation models. The validity of this type of model has been extensively discussed (see references [10, 5, 7]) and many solutions for different geometries can be found in the literature (see references [12, 13, 10, 5, 4, 15]). All these solutions can be formalized within the framework of eigenstrain theory (see references [6, 9]) and the solutions for any finite dislocation can be obtained by superposition of DD singularities for the configuration of interest (half, full-space, layered medium . . . ). The displacements and stresses in the medium induced by a displacement jump across any finite surface can be determined either analytically (using any modern symbolic computation packages) or numerically from the knowledge of these fundamentals solutions. These fundamental solutions can be represented by a third-rank tensor $U_{ijk}(x,x')$ for the displacement and a fourth rank tensor $\Sigma_{ijk}(x,x')$ for the stresses.

Figure 6:
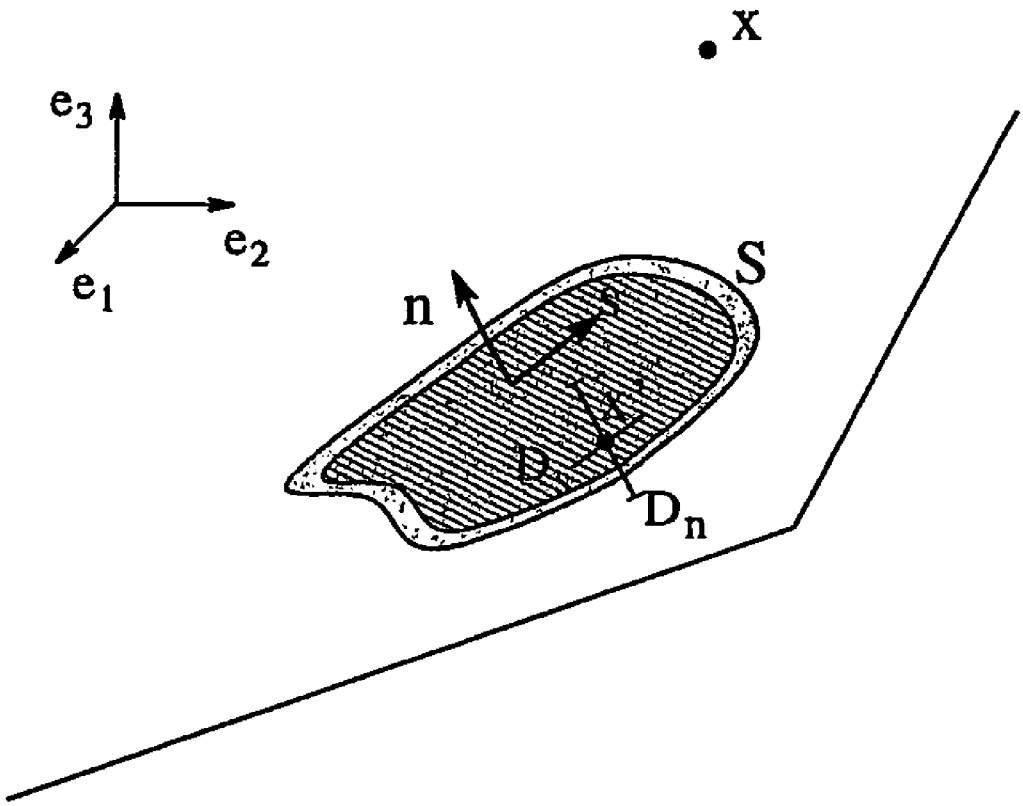
FIG. 6 is a sketch of a planar hydraulic fracture.
Figure 7:
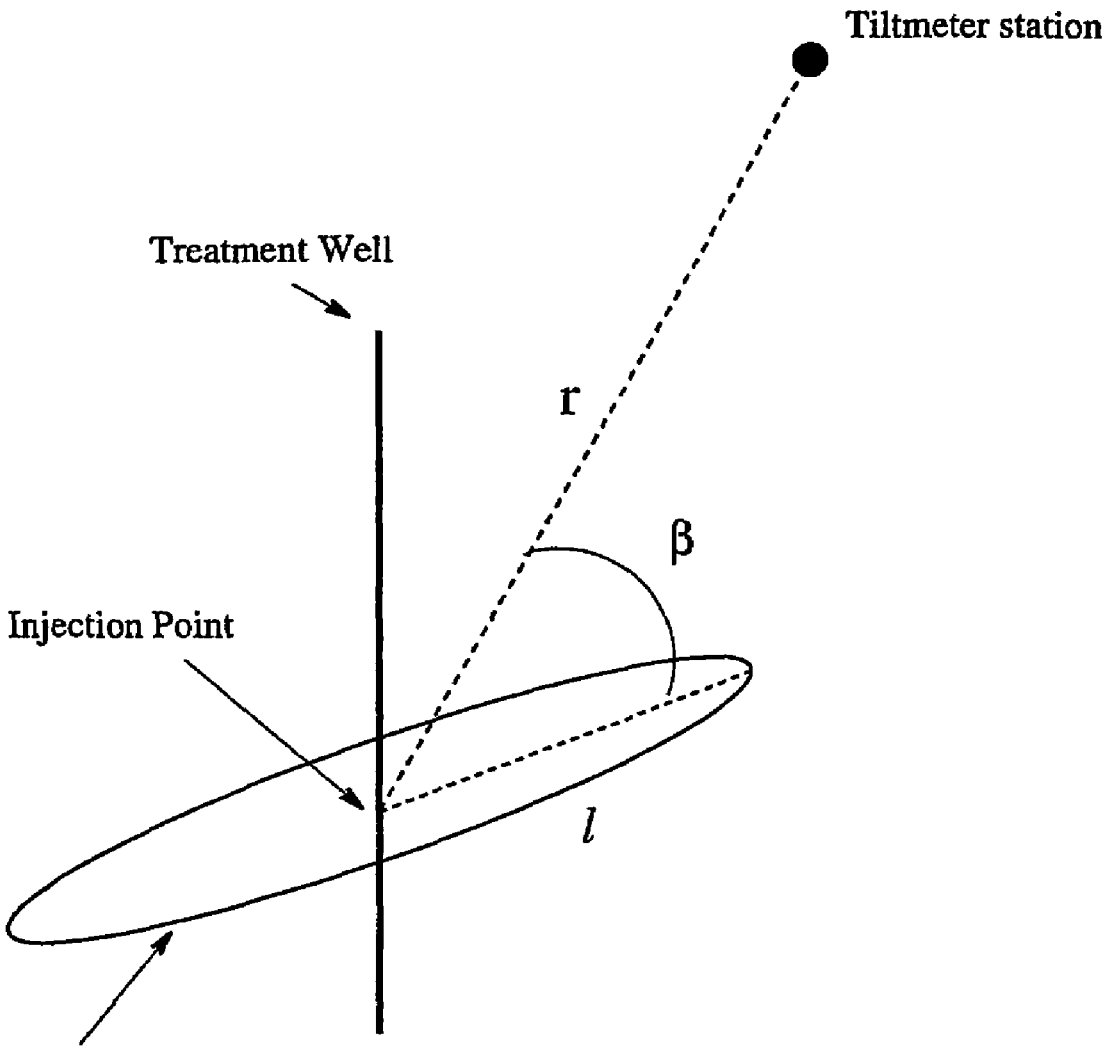
FIG. 7 is a sketch of a hydraulic fracture and the distance of a tiltmeter station to the injection point.

Here, we restrict consideration to planar surf aces and denote by S the surface, with normal n, of a planar finite fracture (or fault) (see FIG. 6). The discontinuity surface can be, for example, a constant opening rectangular planar DD panel or a penny-shaped fracture under uniform pressure and characterized by a variable opening. The displacements u and stresses σ in the medium arising from this dislocation sheet can be obtained from the DD singularity by superposition.

$$u_i(x) = \int_S \{U_{ijk}(x, x')n_j n_k D_n(x') + U_{ijk}(x, x')s_j n_k D_s(x')\} dS \tag{1}$$

$$\sigma_{ij} = \int_S \{\Sigma_{ijkl}(x, x')n_k n_l D_n(x') + \Sigma_{ijkl}(x, x')s_k n_l D_s(x')\} dS \tag{2}$$

$$i, j, k, l = 1, 2, 3 \ (1, 2 \text{ in } 2D)$$

In our notation, $(U_{ijk} \cdot D_{jk})$ denotes the displacement $u_i$ at x induced by a DD singularity of the form $D_{jk}$ located at x'. $(D_{jk} \cdot n_k)$ represents a displacement jump across an element oriented by its unit normal $n_k$. We define $D_n = D_{ij} n_i n_j$ as the normal component of the displacement jump and $D_s = D_{ij} s_i n_j$ as the shear component, with s a unit vector in the plane of the element ($s_i n_i = 0$) indicating the direction of the shear (see FIG. 6). The fundamental solution $\Sigma_{ijkl}$ for stress is a fourth-rank tensor and $(\Sigma_{ijkl} \cdot D_{kl})$ represents the stresses $\sigma_{ij}$ induced by the DD singularity $D_{kl}$. These fundamental kernels contain all the possible orientations for the DD. One has to remember that the DD singularity is restricted to the point x' and has a unit intensity. The fundamental kernels U(x,x'), Σ(x,x') are singular for x=x' and regular otherwise. Evaluation of the integral (1) is therefore straightforward for any x outside the fracture surface S, but special techniques for singular integrals have to be used if x=x' (see reference [8]). In the case of tiltmeter analysis, the measurements are always made outside the DD domain therefore simplifying the evaluation of eq. (1).

The tilts are directly related to the horizontal component of the gradient of the vertical displacement; in our notation $\partial_{x_1} u_3$ and $\partial_{x_2} u_3$. Without loss of generality, we can define a DD singularity gradient tensor $T_{ijkl}(x,x')=\partial_{x_1} U_{ijk}(x,x')$, from which it is possible to obtain the tilt components by superposition.

Far-Field Solution

An important result can be obtained by looking at the far-field behaviour of the displacement solution eq. (1). A point is located in the far-field of the fracture if its distance r from the fracture center is far greater than the fracture characteristic half-length r>>l. We have determined that under these conditions there is far-field equivalence of the displacement fields produced by a finite (tensile) fracture and a DD singularity with an intensity equal to the volume of the finite fracture. Similar results hold for a shear fracture. This equivalence is expected and is a direct illustration of St Venant's principle in elasticity. The far-field influence of fractures can thus simply be modelled using DD singularities of proper intensity by taking advantage of this intrinsic property of elasticity. Therefore, for any points x in the far-field of the fracture the integral (1) reduces to:

$$u_i(x)=V\times U_{ijk}(x,x_c)n_j n_k+S\times U_{ijk}(x,x_c)s_j n_k$$

$$\sigma_{ij}(x)=V\times\Sigma_{ijkl}(x,x_c)n_j n_k+S\times\Sigma_{ijkl}(x,x_c)s_j n_k \tag{3}$$

where $x_c$ denotes the center of the fracture. The volume V of the fracture (i.e the integrated opening profile) and the integrated shear profile S are given by $$V=\int_S D_n(x')dS$$

$$S=\int_S D_s(x')dS$$

An understanding of the intrinsic behaviour of the kernel $U_{ijk}(x,x')$, independent of the elastic domain (infinite, semi-infinite medium . . . ), allows important conclusions to be made regarding the inverse problem of mapping a hydraulic fracture from tiltmeter measurements.

Length Scale Resolution

The major issue is to determine under what conditions tiltmeter data can be used to obtain both the width and size of the fracture modeled as a finite dislocation. As noted in reference [7], the effect of fracture dimensions on the displacement field is weak and the resolution improves for shallow fractures where the measurements are near the fracture. The same qualitative statement can be found in references [21], [3], and [19]. Reference [20] mentions non-uniqueness problems in a laboratory experiments where fracture dimensions are inverted from displacements. None of these references recognizes the issue of the remote location of the measurements in conjunction with the far-field equivalence. It is important to quantify when the far-field equivalence is reached in terms of the distance ratio r/l. In other words, we want to establish a limit function of r/l beyond which only the volume and orientation of the fracture can be resolved from tiltmeter measurements.

In order to investigate at what distance ratio r/l, the dimensions of the fracture can be determined from the displacement field, one can look at the next order terms of the series expansion of the far-field displacement. This far-field expansion for the 3D case can be rewritten as:

$$u_i \propto V\times\frac{x_i}{r^3}\times\left(1+\alpha_i\frac{l^2}{r^2}+O((l/r)^3)\right)\ i=1,3 \tag{4}$$

where $\alpha_i$ is a number of O(1) and its value depends on Poisson's ratio.

We therefore see that the dimensions of the fracture start to have an effect on the displacement field when $(l/r)^2$ is of O(1). When the measurements are at a distance 3 times the characteristic half-length of the fracture, this ratio $(l/r)^2$ is equal to 0.09 which is already negligible compared to 1. This implies that for any point such that r is greater than 3l, where r is the distance from the center of the finite DD of characteristic half-length l, it is practically impossible to distinguish both the opening and the length of a fracture. Under these conditions, only the volume of the fracture V and fracture orientation has an effect on the displacement and tilt fields. The same result holds for a shear fracture, in that case only the integrated shear S and fracture orientation has an effect on the displacement and tilt fields.

As a consequence, the tilt field only weakly reflects the dimensions of a finite fracture of characteristic half-length t if the measurements are further than 2 to 3l. More precisely, taking into account the effect of the fracture plane orientation and using the characteristic fracture size 2l as a reference, the limiting distance can be expressed as:

$$r/(2l)>1.5+|\cos\beta| \tag{5}$$

where β is the relative angle between the fracture plane and the measurement location. According to the previous examples, this bound is clearly optimistic and in some configurations the fracture dimensions already have no effect for (r/2l)=1 .

Resolution of Orientation

We have conducted a detailed investigation via spatial Fourier Transform of the resolution of the fracture orientation. This resolution mainly depends on the relative angle between the fracture plane and the plane where the tiltmeter array is located.

The orientation is better resolved for a relative angle of 45°. In summary:

- A surface tiltmeter array better resolves sub-vertical fractures,
- A borehole tiltmeter array better resolves sub-horizontal fractures.

This confirms observations mentioned in the literature (see references [7, 3, 19].

Field Conditions

Field conditions are such that, in many cases, tiltmeter stations are located so that the condition (5) is satisfied. The recorded tilts therefore do not contain information about both the dimensions (length, height) and opening of the fracture. Attempting to retrieve both length and opening from the tilt data results in an ill-posed problem with an infinite number of solutions, all of which give the same fracture volume. This situation is typically the case for surface tiltmeter array in petroleum applications for monitoring hydraulic fracturing treatments. In the case of downhole tiltmeter arrays where the measurements are located in a monitoring well, the measurements may sometimes be sufficiently close to the fracture to be able to sense the near-field pattern. Unfortunately, if the measurements are located too close to the fracture (condition (5) violated), the proper modeling required to analyse tiltmeter measurements may become very complex and such an analysis can provide an incorrect estimation of the fracture parameters. It is more common and practical to locate the measurements relatively far from the fracture so that the condition (5) is satisfied. Then it is possible to accurately identify the volume and orientation of the fracture, by simply using a DD Singularity as the forward model. The computational efficiency of such a forward model also makes a real time analysis possible. Of course, the distance between the fracture and the measurements must remain compatible with the resolution of the type of tiltmeter used.

Real-Time Efficiency and Orientation

The following proposed analysis method is based on the understanding of the fundamental DD solution and conclusions arising from it described above. It takes advantages of the fact that the parameters with the most effect on tiltmeter are the fracture volume and fracture orientation.

Thus, from the estimation of the fracture volume at a particular time and the recorded injected volume $V_p(t)$ at the same time, we are able to estimate the fracturing efficiency, $\eta$, (in %) at t defined as the ratio between the fracture volume and the injected one.

Modelling and Inversion

Far-Field Tiltmeter Mapping

The tiltmeter stations are located at a distance r from the injection point sufficient for the condition (5) to hold. In that case, the tiltmeters are not able to resolve independently the dimensions of the fracture (width and length) but its volume V (and integrated shear S in the case of shear fracture) can be accurately estimated. On the other hand, this distance r has to be compatible with the resolution of the tiltmeters used. If the tiltmeters are too far away from the fracture or not very sensitive, one may end up recording nothing but ambient noise. If these conditions imposed on the tiltmeter array position and layout are fulfilled, we can take advantage of the far field equivalence between a finite fracture and a DD Singularity of equal volume to simulate the hydraulic fracture.

Near-Field Tiltmeter Mapping

As already pointed out, in most practical situation, we are in a case corresponding to far-field conditions for tiltmeter mapping which greatly simplify the modeling. Nevertheless, the situation of near-field tiltmeter mapping can occur. In that case the tiltmeter are closer to the fracture with regard to the fracture characteristic length (eq. (5) violated). A proper finite fracture model should be used in order to analyse tiltmeter data. Despite the effect of the fracture shape, the most resolvable parameters will remain the fracture volume and orientation, eventually others fracture parameters such as length and height can be obtained from such a near-field analysis.

Geological Conditions

We have to note that depending on the configuration, we may use different solutions. For example, one can either use the finite or semi-infinite elastic domain solution. Solutions are known in analytic form for these two domains. Solutions for a layered medium can also be used if necessary. In that case, the solution can be obtained numerically at a low computational cost using the method developed by Pierce and Siebrits (see references [11, 14]). Any other easily computed model may also be used in the analysis depending on the geological conditions. The only practical requirement is that the solution (tilt at the different stations) for a given fracture volume, orientation etc . . . can be computed in the order of 0.1 second. Therefore, once the analysis is complete in this time frame a real-time estimation of several important fracture parameters is possible.

Inversion

In all cases, the only parameters of the fracture that will be accurately determined are the volume and the orientation of the fracture plane (strike and dip). In most applications, the fracture model is typically centered at the injection point. If needed, this last restriction can be relaxed and the location of the fracture center can be identified.

The values for orientation and volume can be obtained from the recorded tilt at different location and at different times t throughout a fracture treatment. The analysis is based on a classical minimization scheme. As usual for parameter identification problem, the misfit between the measurements and the model are minimized starting from an initial guess for the volume and orientation of the model. The misfit can be for example defined as:

$$J(c(t)) = \frac{1}{2}\sum_{i=1,N} \|T_{model}(x_i, c, t) - T_{measure}(x_i, t)\|^2 \tag{6}$$

where N is the number of a tiltmeter station, $x_i$ is the location of the tiltmeter station, t the time for which the analysis is performed. T represents the tilt and c is a vector of unknown parameters (i.e. c=(Volume,Dip and strike) for far-field tiltmeter). $T_{model}(x_i, c, t)$ are the tilts at the station $x_i$ induced by the fracture model with the values c for the orientation and volume parameters, whereas $T_{measure}$ is the corresponding measurement at station $x_i$.

We can note that it is possible to incorporate a priori information in this type of functional. For example, the strike of the hydraulic fracture may be known from in-situ stress measurements. A comprehensive description of computational techniques for inverse problems is provided in reference [16]. Several minimization algorithms such as gradient based minimization, genetic programming etc. can be used to obtain the optimal parameters c.

The fastest technique will always be a gradient based minimization scheme (such as BFGS with line search) which require of the order of 10 to $100p^2$ evaluations of the model. Note that this number increases dramatically with the number of parameters p to be identified. We are well aware that gradient based methods only converge to a local minima depending on the initial guess. In order to ensure that the solution obtained is a global minima, one simple method is to performed several identifications starting from different initial values for the parameters. This method is well suited to analysis of tilt data as there is a small number of parameters (p=3) involved. As a general rule we start from 4 different initial parameter guesses. In our experience using this approach, we always obtained the same minima.

Treatment Efficiency

As the tiltmeter data are recorded, the volume of the fracture can be estimated in real-time using a inversion procedure such as described above. The analysis procedure may also furnish an estimation of the fracture orientation (dip and strike). At time t during the fracture treatment, from the tiltmeter measurements we are able to obtain via an analysis procedure:

V(t) estimation of the fracture volume at time t, $\theta(t)$ estimation of fracture dip at time t, $\phi(t)$ estimation of fracture strike at time t. Moreover, from the known injected volume $V_p$ (t) at the same time, we are able to estimate the efficiency, $\eta$, (in %) at t:

$$\eta(t) = \frac{V(t)}{V_p(t)} \times 100$$

Poroelastic Effect

In some cases, the rock mass is highly porous and the previous approach should incorporate poroelastic deformations.

The deformation due to the propagation of the hydraulic fracture in a porous reservoir comes on the one hand from the opening of the fracture itself and on the other hand from the poroelastic deformation induced by the fluid leaking into the formation. Under the assumption of zero fluid lag, the injected volume can be readily split in two parts: the volume of the fracture and the volume of fluid leaking into the formation. Introducing the efficiency $\eta = V_{frac}/V_{inj}$, the global volume balance reads at each time:

$$V_{inj} = V_{frac} + V_{leakoff} = \underbrace{\eta V_{inj}}_{\text{Fracture volume}} + \underbrace{(1-\eta)V_{inj}}_{\text{Leak off volume}} \quad (7)$$

The total poroelastic deformation at a given time, is a combination of the two contributions: fracture opening and leak-off. This total deformation can be also decomposed in an instantaneous and transient part. The instantaneous component is due to the sudden change in deformation and pore pressure, while the transient response is controlled by the diffusion of pore pressure in the reservoir. We can estimate the importance of the transient response, by simply looking at the fundamental solutions in poroelasticity derived for the infinite medium (see reference [22]). The transient response is governed by a dimensionless variable $\xi$ defined by:

$$\xi = \frac{r}{\sqrt{4ct}} \quad (8)$$

where c is the rock diffusivity, r the distance from the source and t is the time. For $\xi > 100$, no transient effect is visible. This is typically the case for tiltmeter mapping. Indeed, typical value of the rock mass diffusivity is of the order of $10^{-6}$ to $10^{-8}$ $m^2.s^{-1}$, while the average duration of a HF treatment is of the order of 1 hour and the measurement are always located at more than ten to hundreds of meters from the fracture. If we take these average values, we found that $\xi$ is always above 100 such that only the instantaneous poroelastic deformation is important while analyzing tiltmeter data. When considering only this instantaneous response, the time dependence of the recorded tilts only comes from the propagation of the fracture and not the transient poroelastic effect. One has to keep in mind that for very permeable reservoir and long treatments, the transient effect can eventually become significant.

Combination of Fundamental Solutions

The deformation induced by the fracture opening and the fluid leak-off can be obtained by superposition of poroelastic fundamental solutions.

The effect of fracture opening is obtained using Displacement Discontinuity (DD) singularities as fundamental building blocks to construct solutions for any geometry of finite fracture as previously described for the non-porous case.

The effect of the fluid loss into the formation can be similarly obtained using the fundamental solution for an instantaneous point fluid source (see reference [21]). The displacement and stress at a point x in the medium due to a point fluid source located at $x^1$ are represented by $u_i^s(x,x')$ and respectively $\sigma_{ij}^s(x,x')$.

From knowledge of these fundamental solutions, the displacements and stresses in the medium induced by the combination of a displacement jump and a fluid loss across any finite surface S can be determined either analytically or numerically. Also, the tilts recorded by the tiltmeter can be directly obtained by simple differentiation of the displacement. Here, for clarity, we restrict consideration to planar and opening mode fractures (no shear). Let S denote the surface, with normal n, of a planar finite fracture (see FIG. 6). The displacement gradient (tilt) is given by superposition as:

$$u_{i,l} = \int_s U_{ijk,l}(x, x')n_j n_k D_n(x')dS + \int_s u_{i,l}^3(x, x')C(x')dS \quad (9)$$

where $D_n(x')$ is the intensity of the normal DDs along the fracture: the opening profile. C(x') is the intensity of the fluid loss along the fracture. The surface S can be, for example, a rectangular DD or a penny-shaped crack.

As previously mentioned, we do not consider the effect of the diffusion of pore pressure in the rocks such that the time dependence of the poroelastic effect disappears. In this case, the solution $U_{ijk}$ for the DD is strictly equal to the classical solution in elasticity with undrained elastic parameters. The instantaneous fluid source solution $u_i^s$ also reduces to the elastic solution for a center of dilation with an intensity weighted by a lumped poroelastic parameter $\chi$ instead of the classical elastic one. The instantaneous poroelastic effect only requires the knowledge of elastic solutions. However, the intrinsic difference with the classical elastic models lies in the combination of the fundamental solutions in order to take into account the effect of both fracture opening and fluid leak off on the deformation.

The importance of the instantaneous poroelastic effect due to fluid leak-off is governed by a dimensionless parameters $\chi$ defined as:

$$\chi = \frac{n_p S}{G} \quad (10)$$

where $\eta_p$ is a lumped poroelastic parameter (reference [22]) (not to be mixed with the treatment efficiency), S the storage coefficient and G the shear modulus. It has been found that the poroelastic parameter $\eta_p$ has a value of $\approx 0.25$ for the type of rocks encounter in petroleum geomechanics. For vanishingly small value of the parameter $\chi$, the solution reduces to the elastic one: the influence of the fluid leak off is negligible, the poroelastic effect can be ignored.

Model

The resolution issue derived for the case of a purely elastic rock mass still holds as the poroelastic deformation induced by the fracture is a combination of elastic solutions. Therefore in the case of far-field measurements, the tilts can be simply modeled as:

$$u_{i,l}(x)=V_{frac}U_{ijk,l}(x,x_c)n_jn_k+V_{leakoff}u_{i,l}^{s}(x,x_c) \quad (11)$$

where $x_c$ is the location of the fracture center. The fracture volume and leak-off volume are simply related to the treatment efficiency and injected volume using the global volume balance (7):

$$V_{frac} = \int_s w(x')dS = \eta V_{inj}$$

$$V_{leakoff} = \int_s C(x')dS = (1-\eta)V_{inj}$$

In the porous case, from the recorded tiltmeter data and the injected volume, the inverse analysis will directly estimate the fracture efficiency η together with the fracture orientation.

Practical Requirements

Figure 8:
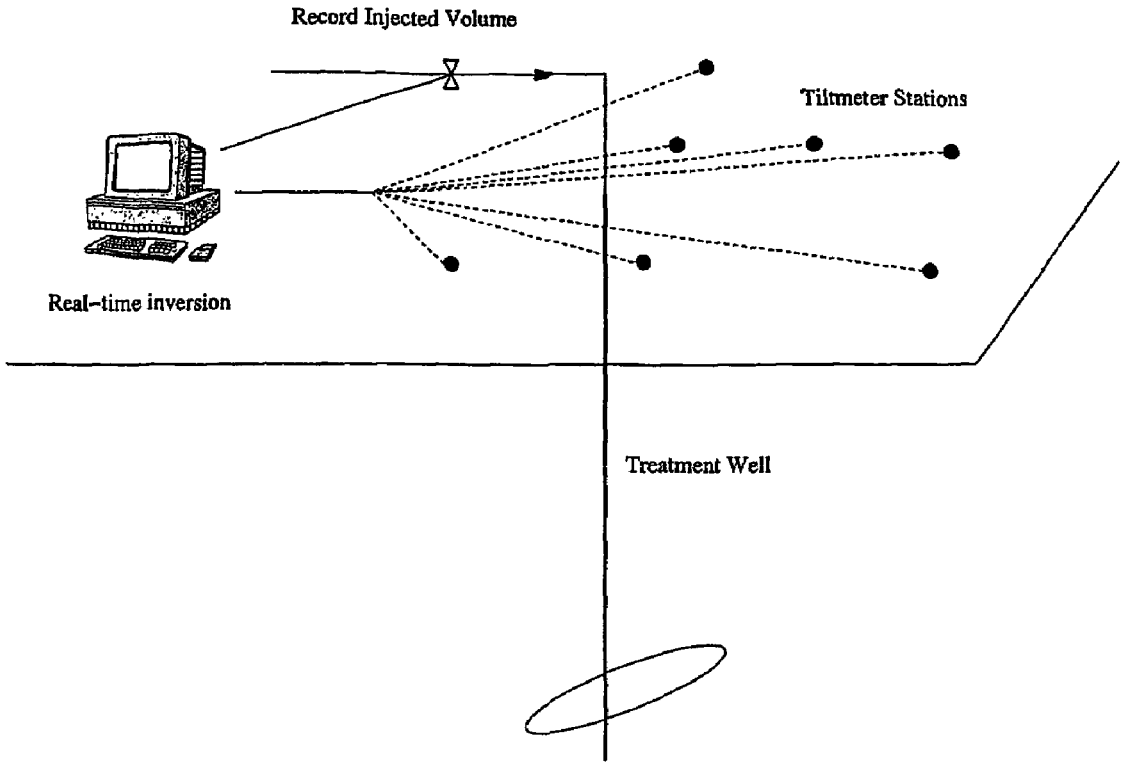
FIG. 8 illustrates an exemplary set up for real-time estimation of fracturing efficiency and orientation during treatment.

In order to successfully implement the method in practice, some additional requirements are needed. All the tiltmeter stations, as well as the measurement of the injected volume, may be connected to a central unit where all the data are collected (see FIG. 8). The data processing and the identification procedure may then run on this central unit or from a unit remotely connected to this unit where the data are gathered.

The sampling rate of the tiltmeters and injection pump can be sufficiently fast to allow enough data to be available for inversion: typically a sampling rate of 15 seconds should be enough. At least 6 tiltmeters stations, properly working will generally ensure that sufficient data is collected for robust operation. More stations may be used to improve the estimation.

Steps of the Analysis and Outcomes

For one time t, the steps of the method are the following:

Sample the injected volume at time t,

Sample every tiltmeter at time t,

Correct the drift for each tilt station (earth tides . . . ), express the two channels in the global coordinate system, Perform the minimization procedure to obtain fracture volume, treatment efficiency, fracture strike and dip at time t, Plot the efficiency history t=[0, t], Plot the fracture orientation history t=[0, t]. This analysis can be repeated every minute or so, using either the total tilt signals from the start of the injection or tilt increment between two sampling point in time.

Figure 9:
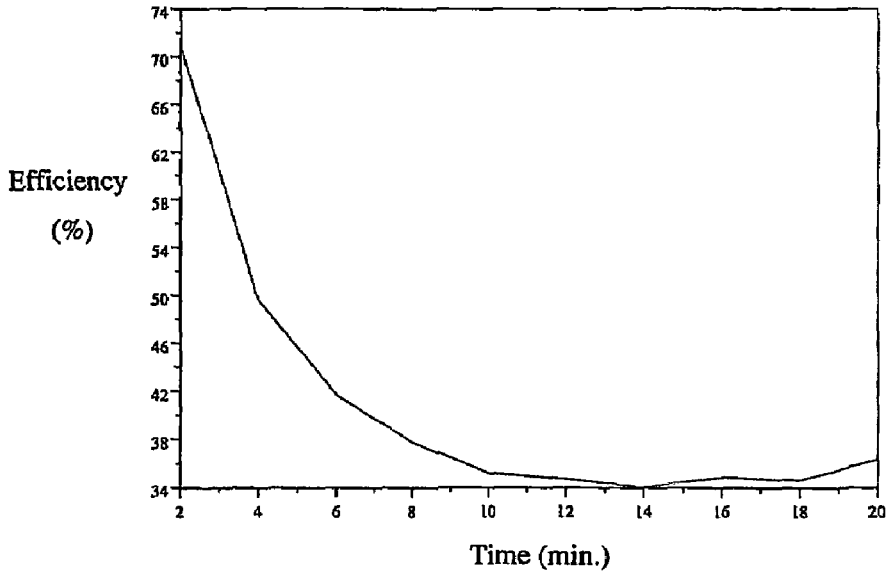
FIG. 9 is an exemplary plot of real-time estimation of treatment efficiency.

By performing this analysis every minute during a treatment (which typically lasts between half an hour to several hours), we are able to produce a plot of the efficiency history η(t) (see FIG. 9 for example). We also get the fracture orientation history. This information is valuable in order to adjust in real-time the treatment parameters: injection rate, fluid type, proppant loading etc . . .

The robustness of the method is ensured by a sufficient amount of data in both space (approximately 6 to 10 tiltmeters properly placed) and time (sufficient sampling rate) together with a model that recognizes the fact that the volume is the only dimensional property available from practical tilt measurement located in the far field (condition (5)).

REFERENCES

[1] Adachi J. I. Fluid-Driven Fracture in a permeable rock. PhD thesis, University Of Minnesota, 2001.

[2] Branagan P. T., Wilmer R. H., Warpinski N. R., and Steinfort T. D. Measuring a deformation of a rock mass around the vicinity of a fracture in a well drilled offset from proposed fracture region. US5934373-A, 1999. Assignee : GRI.

[3] Cipolla C. L. and Wright C. A. Diagnostic techniques to understand hydraulic fracturing: What ? why ? and how ? *Soc. Petrol. Eng.* 59735, 2000.

[4] Crouch S. L. and Starfield A. M. *Boundary element methods in solid mechanics*. George Allen & Unwin, 1983.

[5] Davis P. M. Surface deformation associated with a dipping hydrofracture. *J. Geophys. Res.,* 88:5826-5838, 1983.

[6] Eshelby J. D. The determination of the elastic field of an ellipsoidal inclusion and related problems. *Proc. Roy. Soc. series A,* 241:376-396, 1957.

[7] Evans K. On the development of shallow hydraulic fractures as viewed through the surface deformation field: Part 1-principles. J. Petrol. Tech., 35(2):406-410, 1983.

[8] Hills D. A., Kelly P. A., Dai D. N., and Korsunsky A. M. *Solution of Crack Problems*. Kluwer Academic Publishers, 1996.

[9] Mura T. *Micromechanics of Defects in Solids*. Martinus Nijhoff Publisher, 1982.

[10] Okada Y. Surface deformation due to shear and tensile faults in a half plane. *Bull. Seismol. Soc. Am.,* 75(4):1135-1154, 1985.

[11] Pierce A. P. and Siebrits E. Uniform asymptotic approximations for accurate modeling of cracks in layered elastic media. *Int. J. Fracture*, (110):205-239, 2001.

[12] Rongved L. Dislocation over a bounded plane area in an infinite solid. *J. Appl. Mechanics,* 24:252-254, 1957.

[13] Rongved L. and Frasier J. T. Displacement discontinuity in the elastic half-space. *J. Appl. Mech.,* 25:125-128, 1958.

[14] Siebrits E. and Pierce A. P. An efficient multi-layer planar 3d fracture growth algorithm using a fixed mesh approach. *Int. J. Numer. Meth. Engng,* 53:691-717, 2002.

[15] Sun R. J. Theoritical size of hydraulically induced horizontal fractures and corresponding surface uplift in an idealized medium. *J. Geophys. Res.,* 74(25):5995-6011, 1969.

[16] Vogel C. *Computational Methods for Inverse Problems*. SIAM, 2002.

[17] Warpinski N. R., Steinfort T. D., Branagan P. T., and Wilmer R. H. Apparatus and method for monitoring underground fracturing. U.S. Pat. No. 5,934,373, January 1997. Assignee: GRI.

[18] Wright C., Davis E., Ward J., Samson E., Wang G., Griffin L., Demetrius S. , and Fisher K. Treatment well tiltmeter system, for monitoring fluid motion in subsurface strata from active well, comprises tiltmeter array within borehole, with tiltmeter sensor. WO2001181724-A; WO2001181724-A1; AU2001157342-A, 2001. Assignee: Pinnacle Technologies Inc.

[19] Wright C. A., Weijers L., Davis E. J., and Mayerhofer M. Understanding hydraulic fracture growth: Tricky but not hopeless. *Soc. Petrol. Eng.* 56724, 1999.

[20] Larson M. C., Arthur Verges M., and Keat W. Q (1999) Non destructive identification of three dimensional embedded cracks in finite bodies by inversion of surface displacements. Eng. Frac. Mech., 63:611-629.

[21] Warpinski N. R (2000) Analytic crack solutions for tilt fields around hydraulic fractures. *J Geophys. Res,* 105(B10): 23463-23478.

[22] Cheng A. H. D and Detournay E (1998) On singular integral equations and fundamental solutions of poroelasticity. *Int. J. Solids Structures,* 35(34-35) :4521-4555.

The invention claimed is:

1. A method for estimating a fluid driven fracture volume during hydraulic fracturing treatment of a ground formation, comprising:

positioning a series of tiltmeters at spaced apart tiltmeter stations at which tilt changes due the hydraulic fracturing treatment are measurable by those tiltmeters;

obtaining from the tiltmeters tilt measurements at progressive times during the fracturing treatment; and deriving from the tilt measurements at each of said times an estimate of the fluid driven fracture volume and fracture orientation at that time by performing an analysis based on minimisation of misfit between the tilt measurements at each of said times and tilts predicted by a fracture model to produce estimates of the fluid driven fracture volume and fracture orientation at each of said times as the treatment is in progress;

wherein the tiltmeter stations are located sufficiently far from the fracture that only the volume and orientation of the fracture have significant effect on the tilt fields; and wherein the fracture model used to derive the fracture volume and fracture orientations at each of said times is a displacement discontinuity singularity with an intensity equal to the volume of the simulated fracture.

2. A method as claimed in claim 1, wherein the analysis is carried out at regular time intervals in the range from 10 seconds to 5 minutes throughout the fracturing treatment.

3. Apparatus for estimating a fluid driven fracture volume during hydraulic fracturing treatment of a ground formation, comprising;

a series of tiltmeters positionable at spaced apart tiltmeter stations to measure tilt changes due to the hydraulic fracturing treatment;

a flow meter for measuring the flow of hydraulic fluid injected during a fracturing treatment; and a signal processing unit to receive tilt measurement signals from the tiltmeters at progressive times during the fracturing treatment and operable to derive at each of said times an estimate of the fluid driven fracture volume at that time by performing an analysis sufficiently rapid to produce estimates of the fluid driven fracture volume as the treatment is in progress;

wherein the signal processing unit is operable to receive signals from the flow meter and to compare the estimate of fracture volume at each of said times with the volume of injected fluid as measured by the flow meter so as to derive an indication of treatment efficiency; the signal processing unit is operable to derive from the tilt measurements estimates of fracture orientation at each of said times, the signal processing unit is arranged and configured to perform the analysis by minimisation of misfits between tilt measurement signals from the tiltmeters and tilts predicted by a fracture model that simulates a finite hydraulic fracture and that consists of a displacement discontinuity singularity with an intensity equal to the volume of the simulated fracture.

4. Apparatus as claimed in claim 3, wherein the signal processing unit has the capacity to perform each tilt prediction computation in the order of 1/10 seconds or less.

* * * * *